US008387968B2

(12) United States Patent
Fujikura et al.

(10) Patent No.: US 8,387,968 B2
(45) Date of Patent: Mar. 5, 2013

(54) RECORDING-MATERIAL-FEEDING DEVICE AND IMAGE FORMING APPARATUS

(75) Inventors: Hiroaki Fujikura, Kanagawa (JP); Yuji Otsuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/303,711

(22) Filed: Nov. 23, 2011

(65) Prior Publication Data

US 2012/0326380 A1 Dec. 27, 2012

(30) Foreign Application Priority Data

Jun. 23, 2011 (JP) ..... 2011-139841

(51) Int. Cl.
*B65H 1/08* (2006.01)

(52) U.S. Cl. ..... 271/30.1; 271/157

(58) Field of Classification Search ..... 271/30.1, 271/157

See application file for complete search history.

(56) References Cited

U.S. PATENT DOCUMENTS

| | | | | |
|---|---|---|---|---|
| 6,286,827 | B1 * | 9/2001 | Meetze et al. | 271/162 |
| 6,412,769 | B1 * | 7/2002 | Goda et al. | 271/94 |
| 7,798,489 | B2 * | 9/2010 | Baena et al. | 271/217 |
| 8,041,285 | B2 * | 10/2011 | Hashimoto et al. | 399/379 |
| 8,047,527 | B2 * | 11/2011 | Adachi et al. | 271/9.01 |
| 2001/0015521 | A1 * | 8/2001 | Kashiwagi et al. | 271/30.1 |

FOREIGN PATENT DOCUMENTS

JP A-2002-019978 1/2002

* cited by examiner

*Primary Examiner* — David H Bollinger
(74) *Attorney, Agent, or Firm* — Oliff & Berridge, Plc

(57) ABSTRACT

A recording-material-feeding device includes a stacking portion that holds a stack of recording materials, a lifting member that moves the stacking portion up and down between a feeding position at which a recording material is fed and a refilling position at which refill recording materials are supplied, a suction member that draws one or more recording materials by suction with a negative pressure, a negative-pressure-generating member that generates the negative pressure, and a stopping member that stops an edge of the stack of recording materials on the stacking portion and includes a sealing member that maintains the level of the negative pressure. The sealing member moves up and down between a retracted position at which refill recording materials are supplied and a sealing position at which the level of the negative pressure is maintained, the sealing member moving with the up-and-down movement of the stacking portion.

9 Claims, 10 Drawing Sheets

RECORDING-MATERIAL-FEEDING DEVICE AND IMAGE FORMING APPARATUS

CROSS-REFERENCE TO RELATED APPLICATIONS

This application is based on and claims priority under 35 USC 119 from Japanese Patent Application No. 2011-139841 filed Jun. 23, 2011.

BACKGROUND (i) Technical Field

The present invention relates to a recording-material-feeding device and an image forming apparatus.

(ii) Related Art

A typical electrophotographic image forming apparatus such as a copier, a printer, or a facsimile includes a recording-material-feeding device that feeds a recording material to an image forming section with a predetermined timing. The recording-material-feeding device separates a stack of recording materials into individual recording materials and transports each of the recording materials to the image forming section.

SUMMARY

According to an aspect of the invention, there is provided a recording-material-feeding device including a stacking portion that holds a stack of recording materials, a lifting member that moves the stacking portion up and down between a feeding position at which a recording material is fed and a refilling position at which refill recording materials are supplied, a suction member that draws one or more recording materials by suction with a negative pressure, a negative-pressure-generating member that generates the negative pressure in the suction member, and a stopping member that stops an edge of the stack of recording materials on the stacking portion and includes a sealing member that maintains the level of the negative pressure in the suction member. The sealing member of the stopping member moves up and down between a retracted position at which refill recording materials are supplied and a sealing position at which the level of the negative pressure in the suction member is maintained, the sealing member moving with the up-and-down movement of the stacking portion.

BRIEF DESCRIPTION OF THE DRAWINGS

An exemplary embodiment of the present invention will be described in detail based on the following figures, wherein.

DETAILED DESCRIPTION

Sheet Feeding Unit

An exemplary embodiment of the invention will now be described in detail with reference to the accompanying drawings.

Figure 1:
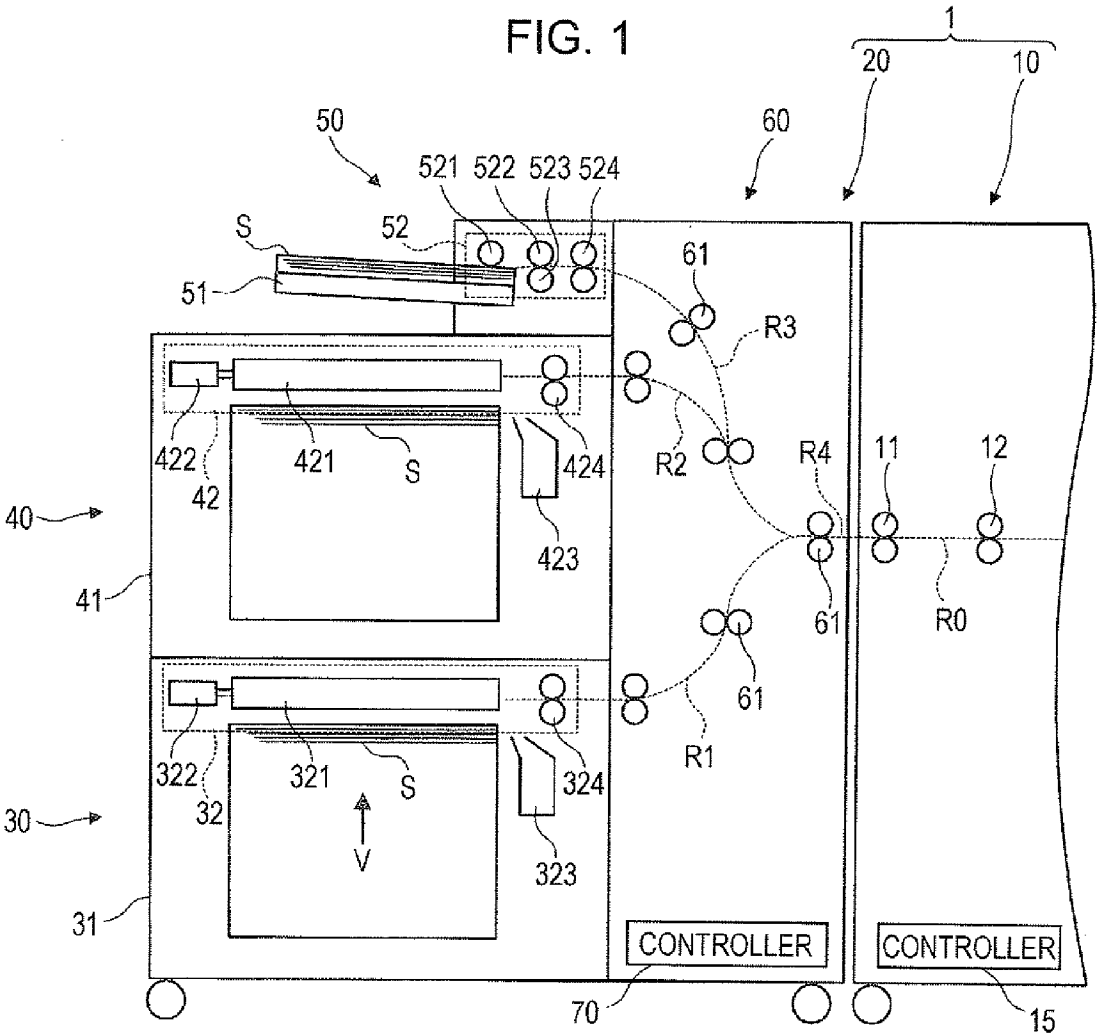
FIG. 1 schematically illustrates an exemplary image forming apparatus to which the exemplary embodiment is applied.

FIG. 1 schematically illustrates an exemplary image forming apparatus 1 to which the exemplary embodiment is applied. The image forming apparatus 1 illustrated in FIG. 1 includes an image-forming-apparatus body 10 and a sheet feeding unit 20 as an exemplary recording-material-feeding device (recording-material-feeding section) that feeds a sheet (recording material) S to the image-forming-apparatus body 10.

The image-forming-apparatus body 10 includes a sheet transport path R0 along which the sheet S, i.e., the object of image formation, is transported, transport rollers 11 and 12 that transport the sheet S along the sheet transport path R0, and an image forming section (not illustrated) that forms an image on the sheet S transported thereto by the transport rollers 11 and 12 and so forth. The image forming section forms an image on the sheet S by, for example, electrophotography. The image-forming-apparatus body 10 further includes a controller 15. The controller 15 controls the transport rollers 11 and 12, the image forming section, and the entirety of the image forming apparatus 1.

The sheet feeding unit 20 includes a first feeding device 30 containing sheets S and feeding each of the sheets S to the image-forming-apparatus body 10, a second feeding device 40 containing sheets S and feeding each of the sheets S to the image-forming-apparatus body 10, a third feeding device 50 feeding each of sheets S manually supplied thereonto to the image-forming-apparatus body 10, a transporting device 60 transporting the sheet S fed thereto from any of the first to third feeding devices 30 to 50 to the image-forming-apparatus body 10, and a controller 70 controlling the first to third feeding devices 30 to 50 and the transporting device 60.

The first feeding device 30 includes a device body 31 and a feeder 32 sequentially feeding the sheets S contained in the device body 31.

Details of the feeder 32 is as follows. The feeder 32 includes an air plenum 321 as an exemplary suction member and a fan 322 as an exemplary negative-pressure-generating member. The air plenum 321 draws one or more sheets S thereto by suction with a negative pressure generated therein by the fan 322.

The first feeding device 30 further includes a blower 323 as an exemplary blower member that blows air onto the sheets S drawn to the air plenum 321 and drops the sheets S except the topmost sheet S, and transport rollers 324 that transport the sheet S remaining on the air plenum 321 to the transporting device 60.

The second feeding device 40 has the same configuration as the first feeding device 30. Specifically, the second feeding device 40 includes a device body 41 and a feeder 42 sequentially feeding the sheets S contained in the device body 41. The feeder 42 includes an air plenum 421 and a fan 422. The air plenum 421 draws one or more sheets S thereto by suction with a negative pressure generated therein by the fan 422.

The second feeding device 40 further includes a blower 423 that blows air onto the sheets S drawn to the air plenum 421 and drops the sheets S except the topmost sheet S, and transport rollers 424 that transport the sheet S remaining on the air plenum 421 to the transporting device 60.

The third feeding device 50 includes a sheet stacking tray 51 on which sheets S are stacked and a feeder 52 that sequentially feeds the sheets S on the sheet stacking tray 51. The feeder 52 includes a pickup roller 521 that is in contact with the topmost one of the sheets S on the sheet stacking tray 51 and picks up one or more sheets S, a feed roller 522 and a retard roller 523 that in combination separate the sheets S picked up by the pickup roller 521 from one another and feed each of the separated sheets S, and transport rollers 524 that transport the sheet S from the feed roller 522 and the retard roller 523 to the transporting device 60.

The transporting device 60 includes a first transport path R1 along which the sheet S from the first feeding device 30 is transported toward the image-forming-apparatus body 10, a second transport path R2 along which the sheet S from the second feeding device 40 is transported toward the image-forming-apparatus body 10, a third transport path R3 along which the sheet S from the third feeding device 50 is transported toward the image-forming-apparatus body 10, and a fourth transport path R4 along which the sheet S transported along any of the first to third transport paths R1 to R3 is transported into the sheet transport path R0 in the image-forming-apparatus body 10. Furthermore, the transporting device 60 includes plural transport rollers 61 provided on the first to fourth transport paths R1 to R4.

For example, although details will be described separately below, when an image is to be formed on a sheet S contained in the first feeding device 30, one or more sheets S are first drawn to the air plenum 321 of the feeder 32 by suction. The sheets S thus drawn are separated from one another by the blower 323, leaving the topmost sheet S on the air plenum 321. Subsequently, the air plenum 321 moves to the right in FIG. 1, whereby the sheet S remaining on the air plenum 321 is delivered to the transport rollers 324. Then, the sheet S is transported into the first transport path R1 in the transporting device 60 by the transport rollers 324. The sheet S is further transported by the transport rollers 61 along the first transport path R1 and the fourth transport path R4 into the sheet transport path R0 in the image-forming-apparatus body 10.

Subsequently, the sheet S is transported along the sheet transport path R0 by the transport rollers 11 and 12 and so forth, and is delivered into the image forming section, where image formation is performed on the sheet S. The sheet S having an image thus formed is then stacked on an output-sheet-stacking portion (not illustrated) provided on the outside of the image-forming-apparatus body 10. In the image forming section, a toner image is formed and is sequentially carried by image carriers such as a photoconductor drum, an intermediate transfer body, and so forth through processes of charging, exposure, and development. The toner image thus formed is transferred to the sheet S by a transfer device and is fixed on the sheet S by a fixing device.

When an image is to be formed on a sheet S stacked on the sheet stacking tray 51 of the third feeding device 50, one or more sheets S are first picked up by the pickup roller 521 of the feeder 52. The sheets S thus picked up are separated from one another by the feed roller 522 and the retard roller 523. Then, each of the separated sheets S is transported into the third transport path R3 in the transporting device 60 by the transport rollers 524. The sheet S is further transported by the transport rollers 61 along the third transport path R3 and the fourth transport path R4 into the sheet transport path R0 in the image-forming-apparatus body 10. The sheet S is then subjected to image formation performed by the image forming section of the image-forming-apparatus body 10, as in the case described above.

First Feeding Device 30

The first feeding device 30 will now be described in more detail.

Figure 2:
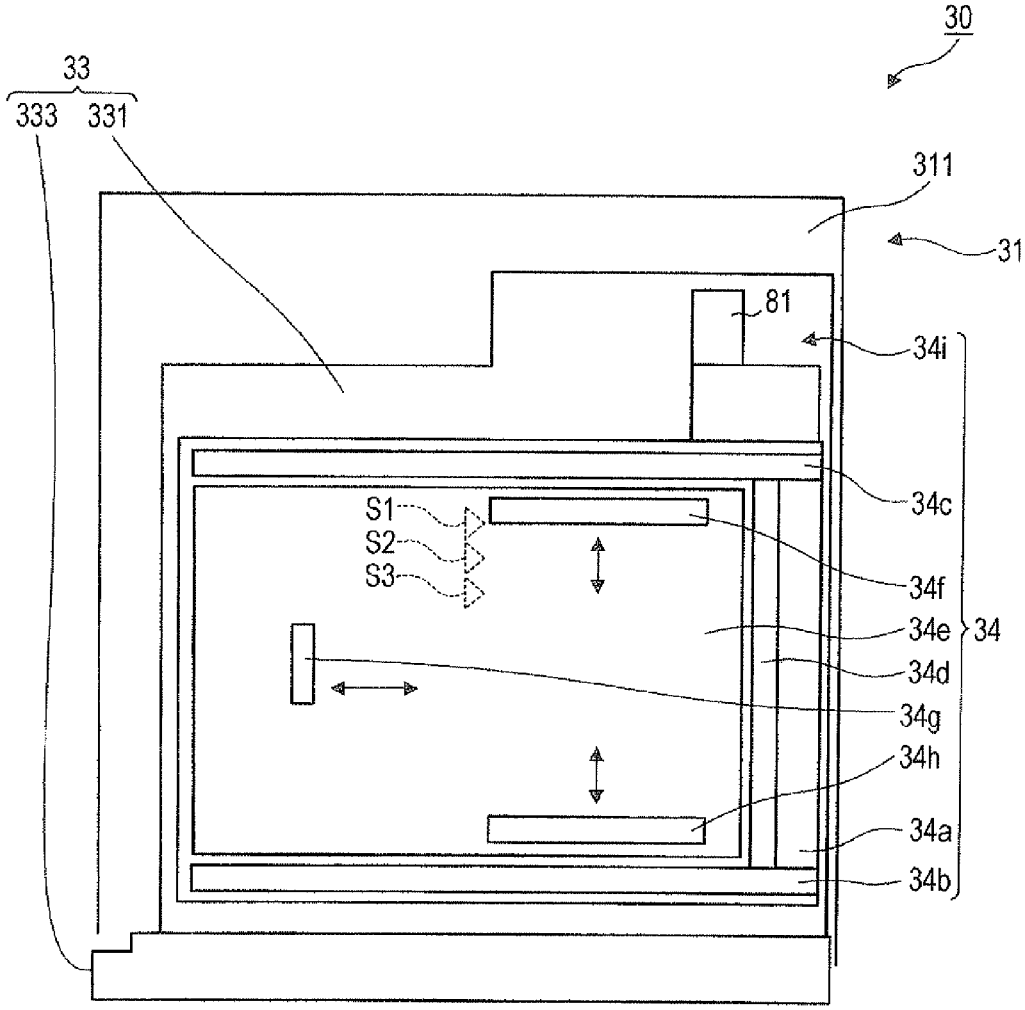
FIG. 2 is a top view of a first feeding device.

FIG. 2 is a top view of the first feeding device 30.

As illustrated in FIG. 2, the first feeding device 30 includes a drawer unit 33 and a container unit 34. The drawer unit 33 is provided at a predetermined position of the device body 31 in such a manner as to be drawable from the front side of the device body 31. The container unit 34 is provided above the drawer unit 33 and contains sheets S.

The drawer unit 33 includes a base plate 331 and a covering 333. The base plate 331 is provided above a base plate 311, which forms the bottom of the device body 31, and below the container unit 34. The covering 333 is provided on the front side of the base plate 331 and is to be held by the user when, for example, the drawer unit 33 is drawn out.

The container unit 34 includes a base plate 34*a*, a first side plate 34*b*, a second side plate 34*c*, and a third side plate 34*d*. The base plate 34*a* is provided above the drawer unit 33 and forms a part of the body of the container unit 34. The first to third side plates 34*b* to 34*d* are fixed to the base plate 34*a* in such a manner as to extend upward perpendicularly to the base plate 34*a*.

The first and second side plates 34*b* and 34*c* are provided opposite each other and extend in the direction of transport of the sheet S. The first side plate 34*b* is on the front side, and the second side plate 34*c* is on the rear side. The third side plate 34*d* is provided on the downstream side of the base plate 34*a* in the direction of transport of the sheet S and extends in a direction orthogonal to the direction of transport of the sheet S.

The container unit 34 further includes a bottom plate 34*e* as an exemplary stacking portion, side guides 34*f* and 34*h*, an end guide 34*g*, a drive portion 34*i*, and detection sensors S1 to S3. The bottom plate 34*e* is vertically movable and holds sheets S stacked thereon. The drive portion 34*i* causes the bottom plate 34*e* to be lifted and lowered. The detection sensors S1 to S3 detect the position of the side guide 34*f*.

The side guides 34*f* and 34*h* are provided between the second side plate 34*c* and the first side plate 34*b* and extend substantially parallel to each other along the second side plate 34*c* and the first side plate 34*b*, respectively. In the exemplary embodiment, the side guide 34*f* is on the rear side, and the side guide 34*h* is on the front side. The side guides 34*f* and 34*h* are movable together back and forth with respect to the second and first side plates 34*c* and 34*b*, respectively. In the exemplary embodiment, the side guides 34*f* and 34*h* are slidable in the direction orthogonal to the direction of transport of the sheet S such that a stack of sheets S is positioned at the center of the bottom plate 34*e* in the direction orthogonal to the direction of transport of the sheet S. That is, for example, when the side guide 34*f* is moved toward the first side plate 34*b*, the side guide 34*h* is moved toward the second side plate 34*c* by the same amount. On the other hand, when the side guide 34*f* is moved toward the second side plate 34*c*, the side guide 34*h* is moved toward the first side plate 34*b* by the same amount. The side guides 34*f* and 34*h* are in contact with the respective widthwise edges of the stack of sheets S on the bottom plate 34*e*, thereby aligning the stack of sheets S.

The end guide 34*g* is provided opposite the third side plate 34*d* and is movable back and forth with respect to the third side plate 34*d*. That is, the end guide 34*g* is slidable in the direction of transport of the sheet S. The end guide 34*g* is in contact with the trailing edge of the stack of sheets S on the bottom plate 34*e*, thereby aligning the stack of sheets S in combination with the third side plate 34*d*.

Thus, the side guides 34*f* and 34*h* and the end guide 34*g* function as stopping members that stop the respective edges of the stack of sheets S on the bottom plate 34*e*.

The drive portion 34*i* includes a motor 81 and plural gears (not illustrated) driven to rotate by the motor 81. The drive portion 34*i* drives a shaft 34*r* (see FIG. 3) to rotate. When the shaft 34*r* is rotated, wires 34*s*, 34*t*, 34*v*, and 34*w* (see FIGS. 3 and 4) are wound around the shaft 34*r*, whereby the bottom plate 34*e* is lifted.

The detection sensors S1 to S3 are provided below the bottom plate 34*e* and side by side in the direction in which the side guide 34*f* moves, thereby detecting the position of the side guide 34*f*. Specifically, the detection sensors S1 to S3 each change between being on and being off with the change in the position of the side guide 34*f*. For example, when sheets S are of the largest size containable, all of the detection sensors S1 to S3 are on. When sheets S are of the smallest size containable, all of the detection sensors S1 to S3 are off. When sheets S are of a size smaller than the largest size containable and larger than the smallest size containable, the detection sensor S3, for example, is on, while the other detection sensors S1 and S2 are off.

The first feeding device 30 will now be described in more detail with reference to FIGS. 3 and 4.

Figure 3:
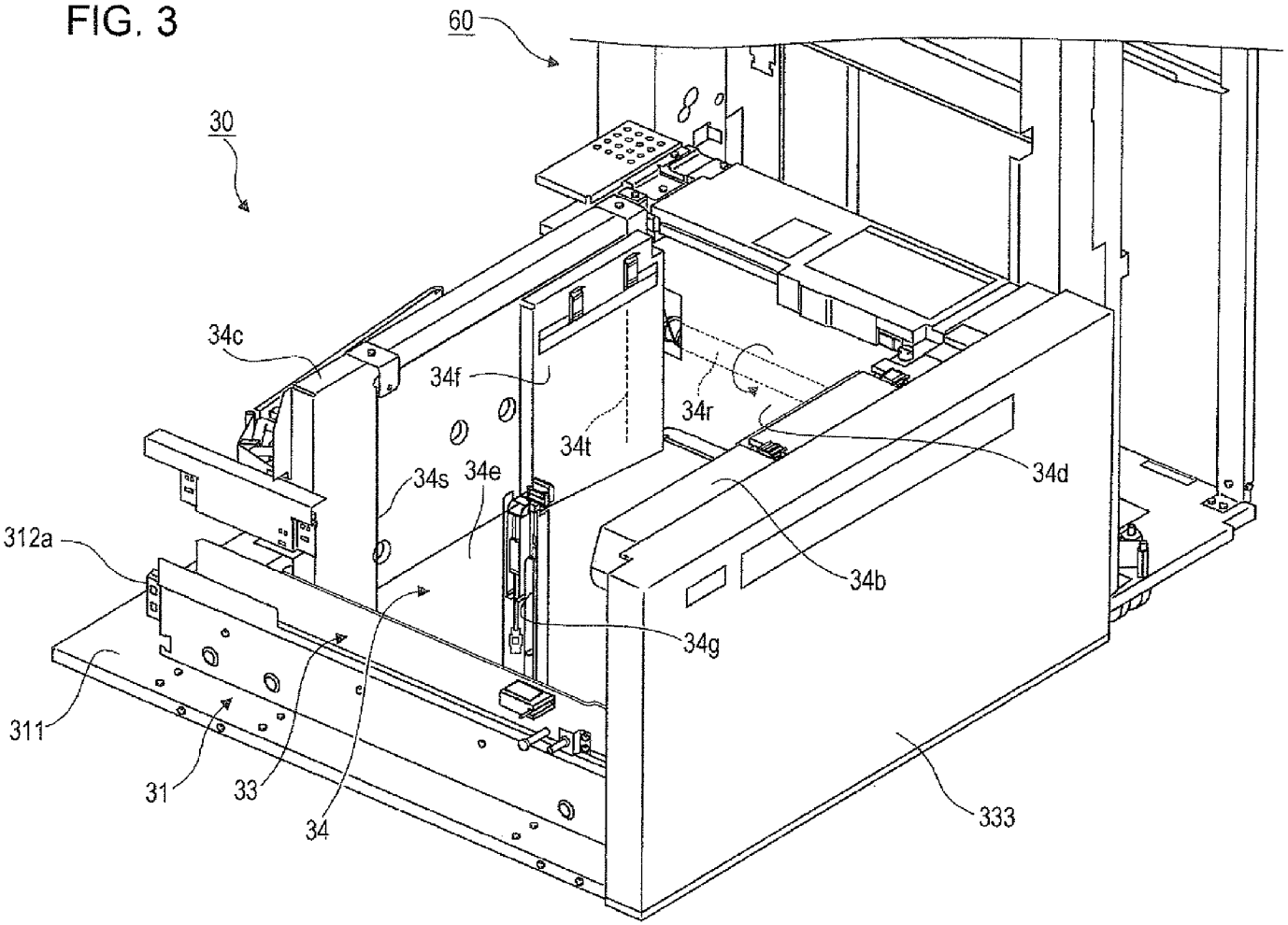
FIG. 3 is a front perspective view of the first feeding device.

FIG. 3 is a front perspective view of the first feeding device 30. FIG. 4 is a rear perspective view of the first feeding device 30. FIGS. 3 and 4 also illustrate the transporting device 60.

As illustrated in FIG. 3, the device body 31 includes an upstream-side guide rail 312*a* provided above the base plate 311 and on the upstream side in the direction of transport of the sheet S. The upstream-side guide rail 312*a* extends in the direction orthogonal to the direction of transport of the sheet S. As illustrated in FIG. 4, the device body 31 further includes a downstream-side guide rail 312*b* provided above the base plate 311 and on the downstream side in the direction of transport of the sheet S. The downstream-side guide rail 312*b* extends in the direction orthogonal to the direction of transport of the sheet S. That is, the device body 31 includes two guide rails 312*a* and 312*b*.

The drawer unit 33 includes first and second guided rails (not illustrated) extending in the direction orthogonal to the direction of transport of the sheet S and guided by the upstream-side and downstream-side guide rails 312*a* and 312*b*, respectively. The drawer unit 33 is slidable in the direction orthogonal to the direction of transport of the sheet S as described above, with the first and second guided rails guided by the upstream-side and downstream-side guide rails 312*a* and 312*b*, respectively.

Figure 4:
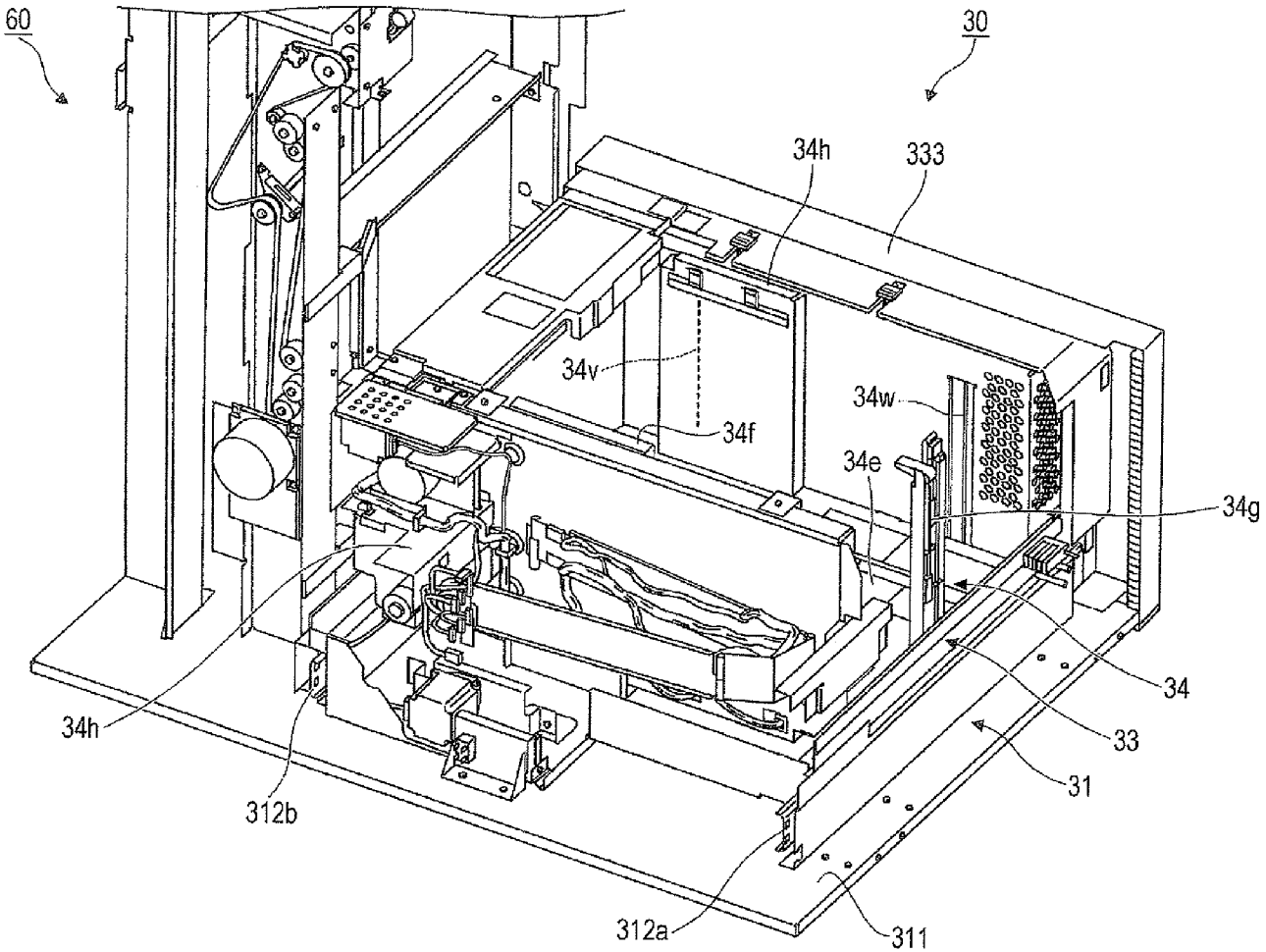
FIG. 4 is a rear perspective view of the first feeding device.

The container unit 34 includes the wires 34*s* and 34*t*, each of which has one end thereof attached to the bottom plate 34*e* as illustrated in FIG. 3, and the wires 34*v* and 34*w*, each of which has one end thereof attached to the bottom plate 34*e* as illustrated in FIG. 4. The container unit 34 further includes the shaft 34*r* illustrated in FIG. 3. When the shaft 34*r* is driven to rotate by the motor 81 of the drive portion 34*i* (see FIG. 2), the wires 34*s*, 34*t*, 34*v*, and 34*w* are wound around the shaft 34*r*. The shaft 34*r* extends in the direction orthogonal to the direction of transport of the sheet S. In the exemplary embodiment, when the shaft 34*r* is rotated by the motor 81 in a direction of the arrow illustrated in FIG. 3, the wires 34*s*, 34*t*, 34*v*, and 34*w* are wound up around the shaft 34*r*, whereby the bottom plate 34*e* is lifted. In contrast, when the shaft 34*r* is rotated in a direction opposite to the direction of the arrow, the wires 34*s*, 34*t*, 34*v*, and 34*w* are unwound from the shaft 34*r*, whereby the bottom plate 34*e* is lowered.

With such a mechanism, the bottom plate 34*e* is movable between a feeding position at which a sheet S is fed to the image forming section and a refilling position at which refill sheets S are supplied. In the exemplary embodiment, the feeding position of the bottom plate 34*e* is at an upper position of the first feeding device 30, and the refilling position of the bottom plate 34*e* is at a lower position of the first feeding device 30. In the exemplary embodiment, the motor 81, the shaft 34*r*, and the wires 34*s*, 34*t*, 34*v*, and 34*w* function as lifting members that move the bottom plate 34*e* up and down between the feeding position at which a sheet S is fed and the refilling position at which refill sheets S are supplied.

Air Plenum 321

The air plenum 321 will now be described in detail.

Figure 5:
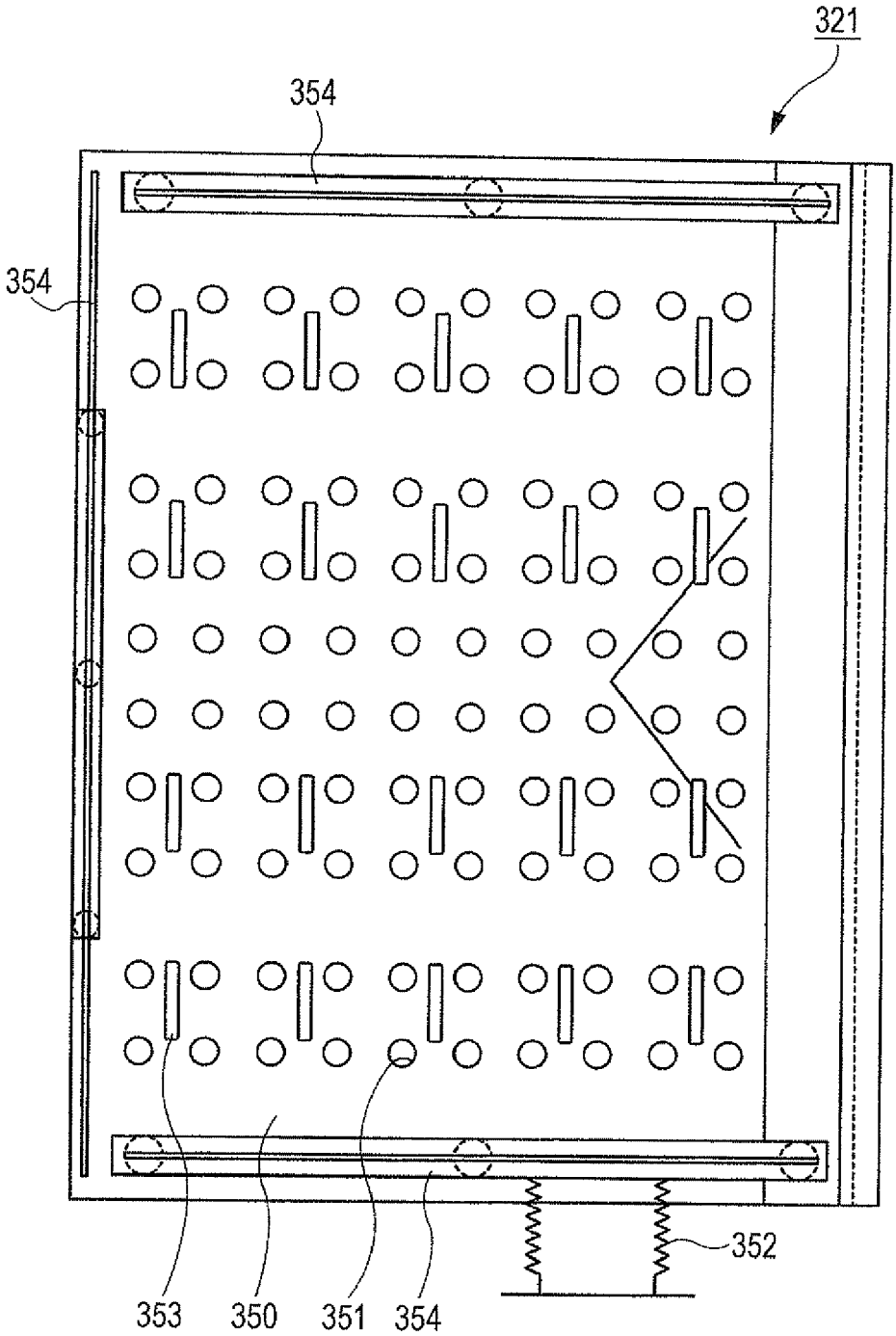
FIG. 5 illustrates an air plenum seen in the direction of arrow V illustrated in FIG. 1.

FIG. 5 illustrates the air plenum 321 seen in the direction of arrow V illustrated in FIG. 1.

As illustrated in FIG. 5, the air plenum 321 has a sheet suction surface 350 and draws one or more sheets S thereto by suction applied through the sheet suction surface 350. The sheet suction surface 350 has air holes 351 provided at predetermined intervals. Suction is applied through the air holes 351. The air plenum 321 has a hollow space at the back of the sheet suction surface 350. The hollow space is connected to the fan 322 (see FIG. 1) with a duct 352. Therefore, when the fan 322 is activated, air is drawn by suction through the air holes 351, whereby a negative pressure is generated over the entirety of the sheet suction surface 350. In addition to the air holes 351, the sheet suction surface 350 has ribs 353 provided at predetermined intervals. Therefore, the sheet S drawn to the sheet suction surface 350 and remaining on the sheet suction surface 350 is prevented from being in close contact with the sheet suction surface 350 with the presence of the ribs 353. Hence, when the fan 322 is stopped and the generation of negative pressure is stopped, the sheet S is easily released from the sheet suction surface 350. Accordingly, the sheet S is easily delivered to the transport rollers 324 (see FIG. 1).

The air plenum 321 further includes sealing plates 354 as exemplary sealing members that are provided along the outer perimeter thereof and maintain the level of the negative pressure generated in the air plenum 321.

Figure 6A:
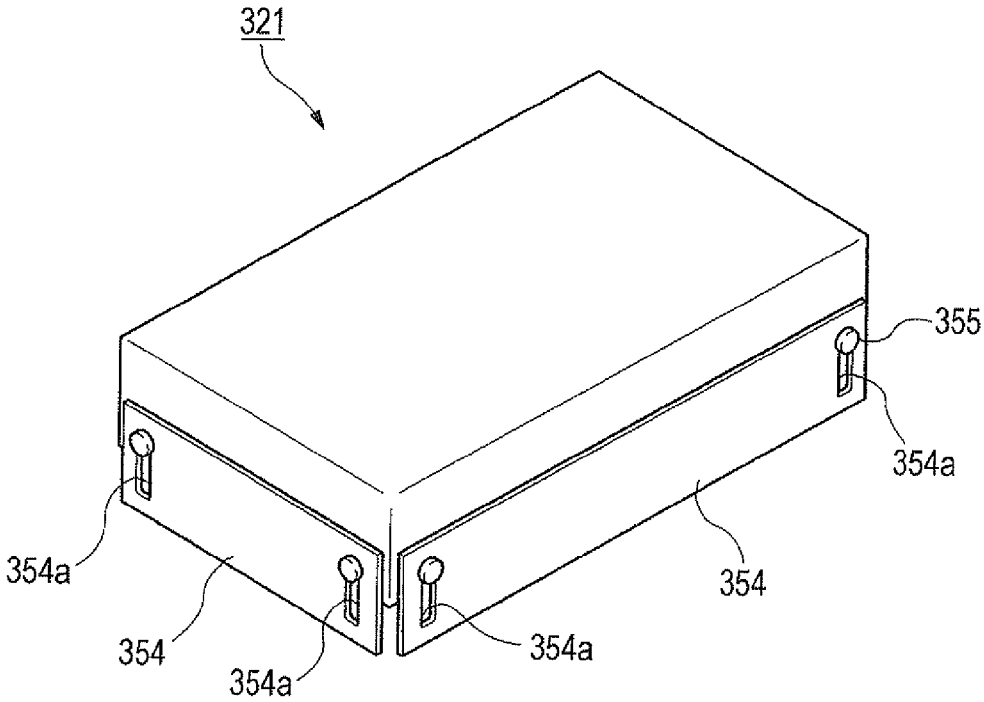
FIGS. 6A and 6B illustrate sealing plates of the air plenum.
Figure 6B:
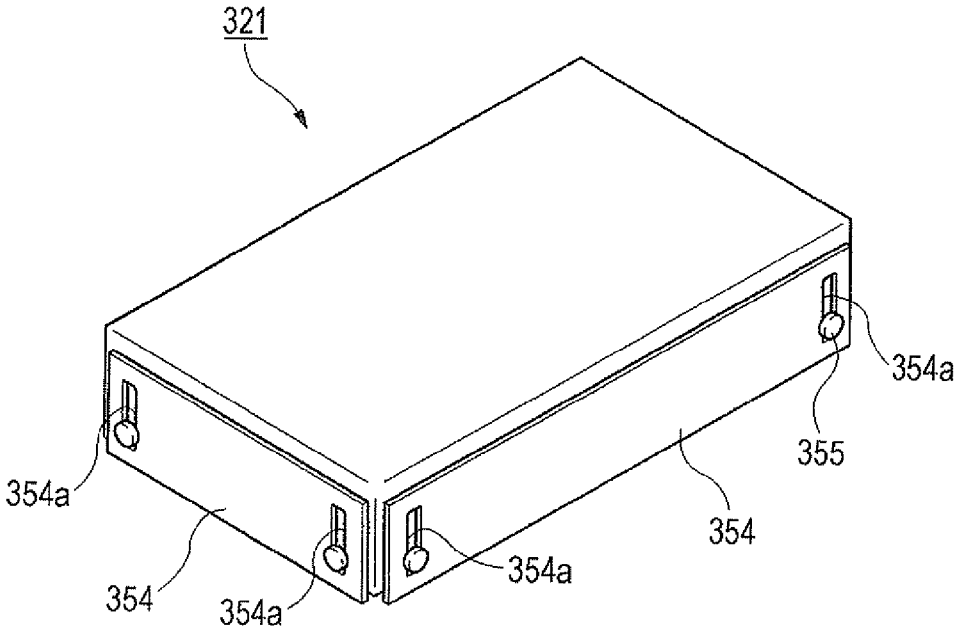

FIGS. 6A and 6B illustrate the sealing plates 354 of the air plenum 321.

As illustrated in FIGS. 6A and 6B, the sealing plates 354 are thin plate members and each have, for example, two holes 354*a*. The holes 354*a* have, for example, rectangular shapes. The sealing plates 354 are supported by pins 355 provided on side faces of the air plenum 321 and extending through the respective holes 354*a*. The sealing plates 354 are not fixed by the pins 355 and are movable in the vertical direction in FIGS. 6A and 6B. That is, the sealing plates 354 are freely movable in the vertical direction within a range in which the pins 355 are movable within the respective holes 354*a*.

When the bottom plate 34*e* (see FIG. 2) is at the refilling position at which refill sheets S are supplied, the sealing plates 354 are pulled down by the force of gravity (the state illustrated in FIG. 6A). In contrast, when the bottom plate 34*e* is at the feeding position at which a sheet S is fed, the stack of sheets S is in contact with the bottom ends of the sealing plates 354, lifting up the sealing plates 354 (the state illustrated in FIG. 6B). That is, the sealing plates 354 move up and down with the change in the height of the stack of sheets S. Hence, gaps are not liable to be produced between the bottom ends of the sealing plates 354 and the stack of sheets S. Therefore, when the air plenum 321 is to draw one or more sheets S thereto by suction, the probability that air may flow into gaps between the air plenum 321 and the stack of sheets S is reduced. Thus, a reduction in the negative pressure generated in the air plenum 321 is suppressed. That is, the level of the negative pressure generated in the air plenum 321 is maintained by the sealing plates 354. In the exemplary embodiment, the sealing plates 354 are each, for example, a plastic plate having a thickness of about 0.5 mm.

The size of sheets S to be used in the sheet feeding unit 20 (see FIG. 1) varies. Sheets S having a width smaller than that of the air plenum 321 may be stacked on the bottom plate 34*e*.

In such a case, gaps are produced between the stack of sheets S and the sealing plates 354, and air flows into the gaps. Therefore, the effect produced by the sealing plates 354 tends not to be fully exerted, and it is difficult to maintain the level of the negative pressure generated in the air plenum 321. Consequently, the efficiency in drawing one or more sheets S to the air plenum 321 by suction is reduced, making it difficult to transport each sheet S at a high speed.

Such a problem may be addressed by setting the width of the air plenum 321 to be smaller than the width of sheets S of the smallest size containable. In such a case, however, the area of the sheet suction surface 350 of the air plenum 321 is reduced. Therefore, if sheets S are of a large size or are cardboards, each sheet S is heavy and is difficult to draw to the air plenum 321 by suction. Nevertheless, if additional sealing plates 354 are provided inside the air plenum 321, sheets S of different sizes may be handled. In such a configuration, however, the sheet suction surface 350 is divided into several parts by the sealing plates 354 when one or more sheets S are drawn thereto by suction. Therefore, the force of suction is liable to become weak and nonuniform over the entirety of the sheet suction surface 350.

As described above, when the bottom plate 34*e* is at the refilling position at which refill sheets S are supplied, the sealing plates 354 of the air plenum 321 are pulled down and the bottom ends thereof are at low positions. Therefore, when the container unit 34 (see FIG. 2) is inserted or is drawn out, the top ends of the side guides 34*f* and 34*h* need to be at lower positions than the bottom ends of the sealing plates 354 so that the side guides 34*f* and 34*h* do not interfere with the sealing plates 354. Hence, when one or more sheets S are drawn by suction, the side guides 34*f* and 34*h* may not be able to stop the entirety of the side edges of the sheets S in a floating state. Therefore, the orientation of each of the sheets S may change during suction. Consequently, the sheet S may be transported obliquely.

Accordingly, in the exemplary embodiment, the side guides 34*f* and 34*h* and the end guide 34*g* are provided with sealing members in terms of addressing the occurrence of the above situation. The following description concerns an exemplary sealing member provided on the side guide 34*f*. The configuration of the exemplary sealing member also applies to sealing members provided on the side guide 34*h* and the end guide 34*g*.

Sealing Member Provided on Side Guide 34*f*

Figure 7A:
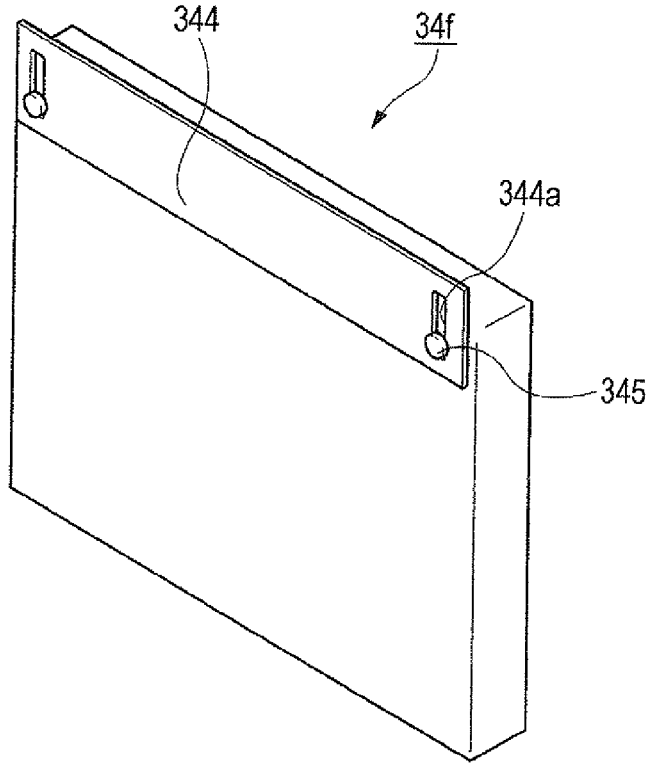
FIGS. 7A and 7B illustrate an exemplary sealing member provided on one side guide.
Figure 7B:
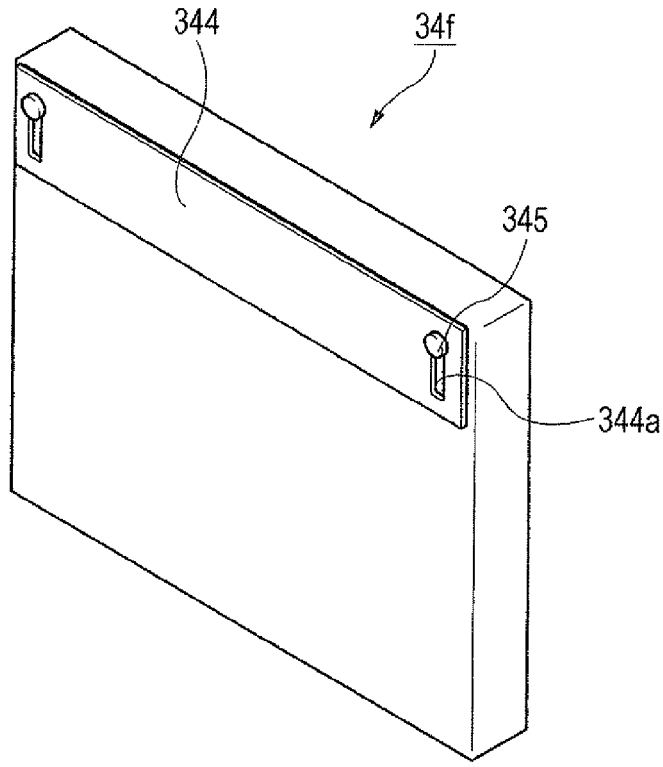

FIGS. 7A and 7B illustrate the exemplary sealing member provided on the side guide 34*f*.

The side guide 34*f* illustrated in FIGS. 7A and 7B has a sealing plate 344 as the exemplary sealing member that maintains the level of the negative pressure generated in the suction member, i.e., the air plenum 321. The sealing plate 344 is movable in the vertical direction with the presence of holes 344*a* provided therein. The sealing plate 344 has a configuration similar to that of the above-described sealing plates 354 provided on the air plenum 321. That is, the sealing plate 344 is a thin plate member and has, for example, two rectangular holes 344*a*. The sealing plate 344 is supported by pins 345 provided on a side face of the side guide 34*f* and extending through the respective holes 344*a*. The sealing plate 344 is movable in the vertical direction, in FIGS. 7A and 7B, within a range in which the pins 345 are movable within the respective holes 344*a*. In the exemplary embodiment, the sealing plate 344 is, for example, a plastic plate having a thickness of about 0.5 mm.

Note that the sealing plate 344 differs from the sealing plates 354 provided on the air plenum 321 in that the sealing plate 344 moves with the up-and-down movement of the stacking portion, i.e., the bottom plate 34*e*. In the exemplary embodiment, the sealing plate 344 moves between a position taken when the bottom plate 34*e* is lifted and at which the level of the negative pressure generated in the air plenum 321 is maintained and a position taken when the bottom plate 34*e* is lowered and at which refill sheets S are supplied. More specifically, the sealing plate 344 moves up and down, with the up-and-down movement of the bottom plate 34*e*, between a retracted position at which refill sheets S are supplied and a sealing position at which the level of the negative pressure generated in the air plenum 321 is maintained.

That is, when the bottom plate 34*e* is lifted, the sealing plate 344 moves upward to the position (sealing position) at which the top end thereof is in contact with the sheet suction surface 350 of the air plenum 321 (the state illustrated in FIG. 7A). Thus, gaps are not liable to be produced between the top end of the sealing plate 344 and the sheet suction surface 350. Therefore, the probability that air may flow into gaps between the sealing plate 344 and the sheet suction surface 350 is reduced, and the level of the negative pressure generated in the air plenum 321 is maintained. Consequently, the level of the negative pressure generated in the air plenum 321 is not liable to vary with the size of the stack of sheets S. That is, the level of the negative pressure generated in the air plenum 321 is stabilized, regardless of the size of the stack of sheets S. Thus, the air plenum 321 stably draws thereto sheets S of different sizes by suction.

When the air plenum 321 draws one or more sheets S thereto by suction, the sheets S are stopped by the sealing plate 344. That is, in the exemplary embodiment, even if the side guide 34*f* is configured such that the top end thereof is at a lower position than the bottom ends of the sealing plates 354 so that the side guide 34*f* does not interfere with the sealing plates 354 when the container unit 34 (see FIG. 2) is inserted or is drawn out, a side edge of each of the sheets S in the floating state is stopped by the sealing plate 344. Therefore, the orientation of the sheet S is not liable to change during suction. Consequently, the sheet S is not liable to be transported obliquely.

When the bottom plate 34*e* is lowered, the sealing plate 344 moves downward in FIGS. 7A and 7B. Thus, except when one or more sheets S are drawn to the air plenum 321 by suction, the sealing plate 344 does not project from the top end of the side guide 34*f*. Therefore, when the container unit 34 (see FIG. 2) is inserted or is drawn out, the sealing plate 344 does not interfere with, for example, the sealing plates 354 provided on the air plenum 321.

Mechanism of Lifting and Lowering Sealing Plate 344

Figure 8B:
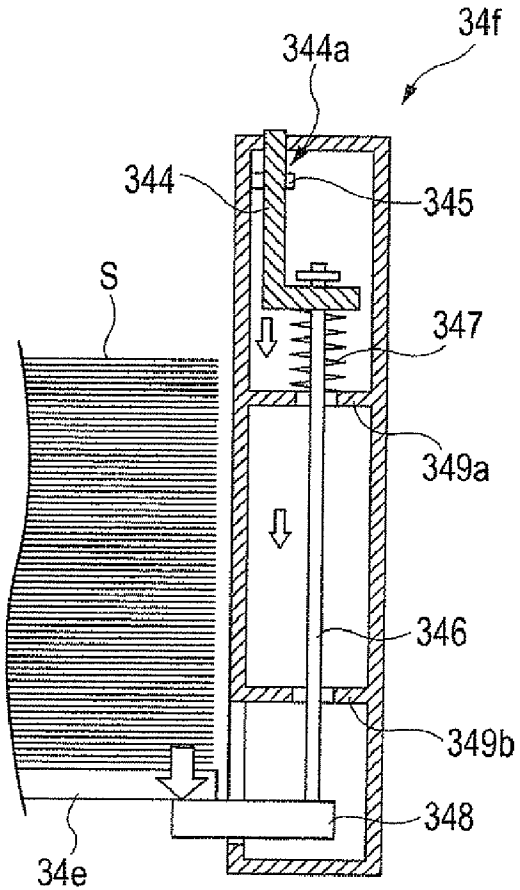
FIGS. 8A and 8B illustrate an exemplary mechanism of lifting and lowering the sealing plate.
Figure 8A:
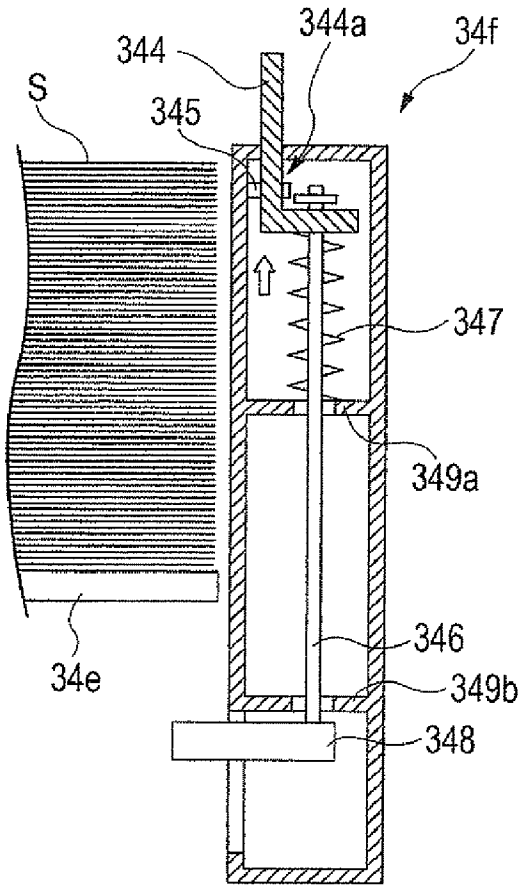

FIGS. 8A and 8B illustrate an exemplary mechanism of lifting and lowering the sealing plate 344.

In the case illustrated in FIGS. 7A and 7B, the sealing plate 344 is provided on a side face of the side guide 34*f*. Alternatively, as illustrated in FIGS. 8A and 8B, the sealing plate 344 may be retractable into the side guide 34*f*. In the case illustrated in FIGS. 8A and 8B, the sealing plate 344 has a lower portion thereof bent, thereby having an L shape. A shaft 346 extends through the lower portion of the sealing plate 344. The sealing plate 344 is fixed to the top of the shaft 346. The side guide 34*f* has partitions 349*a* and 349*b* thereinside. The shaft 346 also extends through the partitions 349*a* and 349*b*. A spring 347 is interposed between the sealing plate 344 and the partition 349*a*. A lever 348 is provided at the bottom of the shaft 346 in such a manner as to extend toward the bottom plate 34*e*. The sealing plate 344 has rectangular holes 344*a* similar to those illustrated in FIGS. 7A and 7B. The sealing plate 344 is supported by pins 345 provided on an inner sidewall of the side guide 34*f* and extending through the holes 344*a*.

In such a configuration, the sealing plate 344 is movable in the vertical direction, in FIGS. 8A and 8B, within a range defined by the shaft 346 and the pins 345.

As illustrated in FIG. 8A, when the bottom plate 34*e* is at the feeding position at which a sheet S is fed, the sealing plate 344 is pushed upward by the spring 347, and the top end of the sealing plate 344 comes into contact with the sheet suction surface 350 of the air plenum 321. With the presence of the partition 349*b*, the position of the sealing plate 344 becomes the highest when the lever 348 comes into contact with the partition 349*b*.

As illustrated in FIG. 8B, when the bottom plate 34*e* is moved to the refilling position at which refill sheets S are supplied, the bottom plate 34*e* comes into contact with the lever 348 and pushes down the lever 348. Simultaneously, the shaft 346 moves downward, and the sealing plate 344 fixed to the shaft 346 also moves downward. Thus, when the bottom plate 34*e* is at the refilling position, the sealing plate 344 is retracted in the side guide 34*f*. When the bottom plate 34*e* is moved from the refilling position to the feeding position, the bottom plate 34*e* moves away from the lever 348, and the sealing plate 344 returns to the position illustrated in FIG. 8A with the force of the spring 347.

If the above sealing plate 344 is employed, the sealing plates 354 of the air plenum 321 may not necessarily be provided. If the sealing plates 354 are provided, however, the level of the negative pressure generated in the air plenum 321 is more stabilized, and each sheet S is more stably drawn to the air plenum 321 by suction.

Procedure of Feeding Sheet S by First Feeding Device 30

A specific procedure in which the first feeding device 30 feeds a sheet S will now be described.

FIGS. 9A to 9F illustrate the procedure in which the first feeding device 30 (see FIG. 1) feeds a sheet S.

Figure 9A:
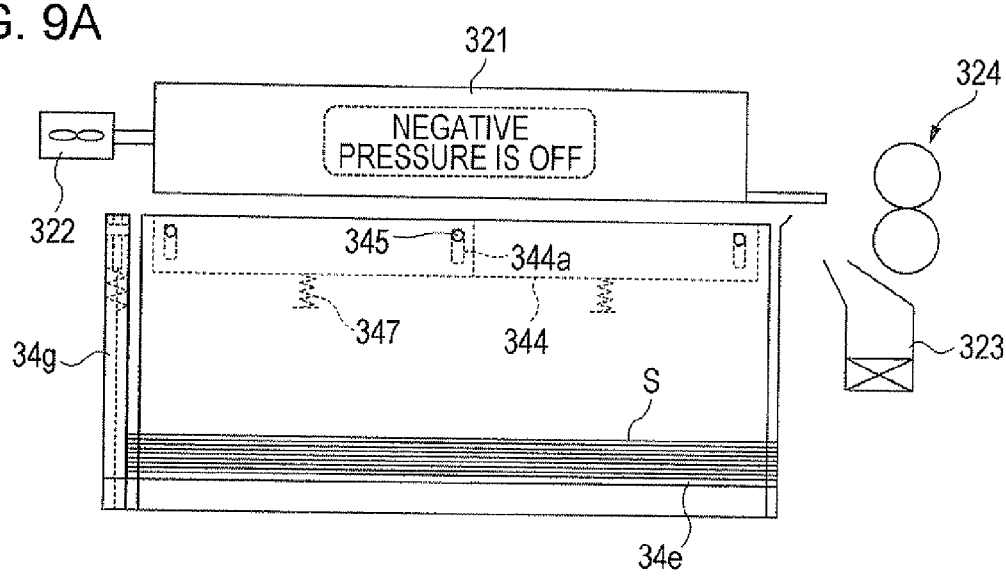
FIGS. 9A to 9F illustrate a procedure in which the first feeding device feeds a heet.

FIG. 9A illustrates a state where refill sheets S are to be supplied and the bottom plate 34*e* is at the refilling position at the bottom of the first feeding device 30. In this state, refill sheets S can be supplied by drawing out and inserting the container unit 34 (see FIG. 2). Furthermore, in this state, the sealing plates 344 are lowered and are retracted in the side guides 34*f* and 34*h* and the end guide 34*g*, that is, the sealing plates 344 are at the retracted position. In FIGS. 9A to 9F, members such as the side guide 34*f*, the shaft 346, and so forth provided around the sealing plates 344 are not illustrated to avoid complexity.

Figure 9B:
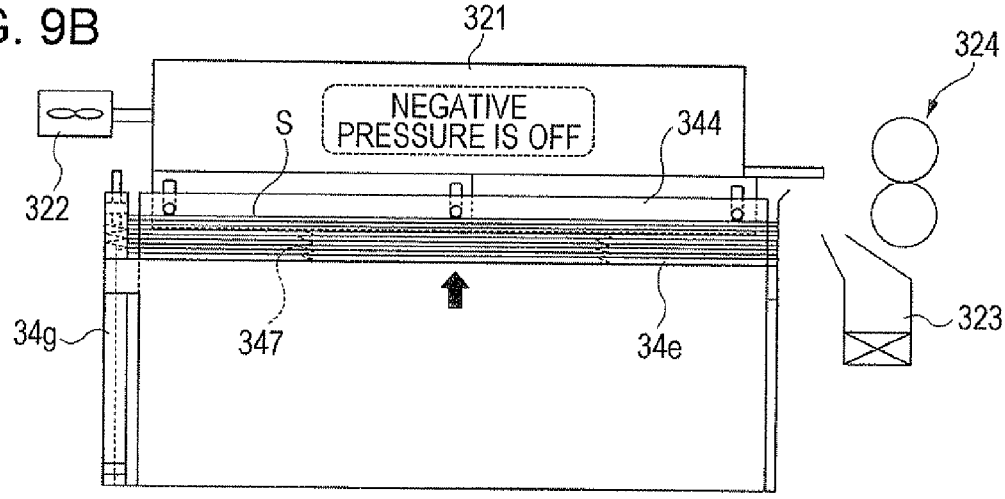

When refill sheets S have been supplied, the lifting members that move the bottom plate 34*e* up and down are activated and the bottom plate 34*e* is lifted as illustrated in FIG. 9B. The bottom plate 34*e* stops at the feeding position defined at an upper position of the first feeding device 30. With the movement of the bottom plate 34*e*, the sealing plates 344 move upward and the top ends thereof come into contact with the sheet suction surface 350 (see FIG. 5) of the air plenum 321. Thus, the sealing plates 344 are brought to the sealing position.

Figure 9C:
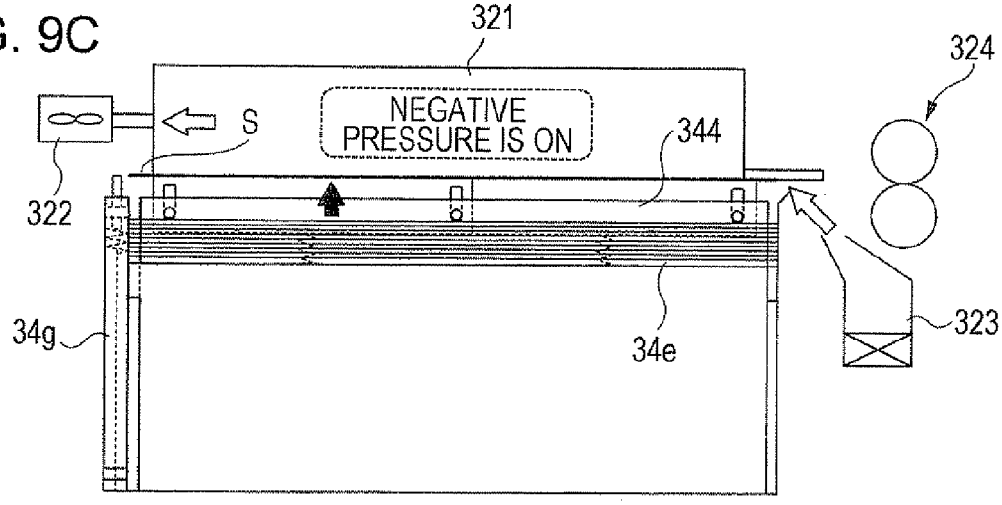

To feed a sheet S from the first feeding device 30, the fan 322 is activated and a negative pressure is generated in the air plenum 321 as illustrated in FIG. 9C. With the negative pressure, one or more sheets S are drawn to the sheet suction surface 350 of the air plenum 321 by suction. In this operation, the blower 323 is also activated and starts to blow air. In a case where plural sheets S are drawn toward the air plenum 321, the air from the blower 323 hits the plural sheets S and drops all the sheets S but the topmost sheet S. Thus, the plural sheets S are separated from one another and are fed one by one.

Figure 9D:
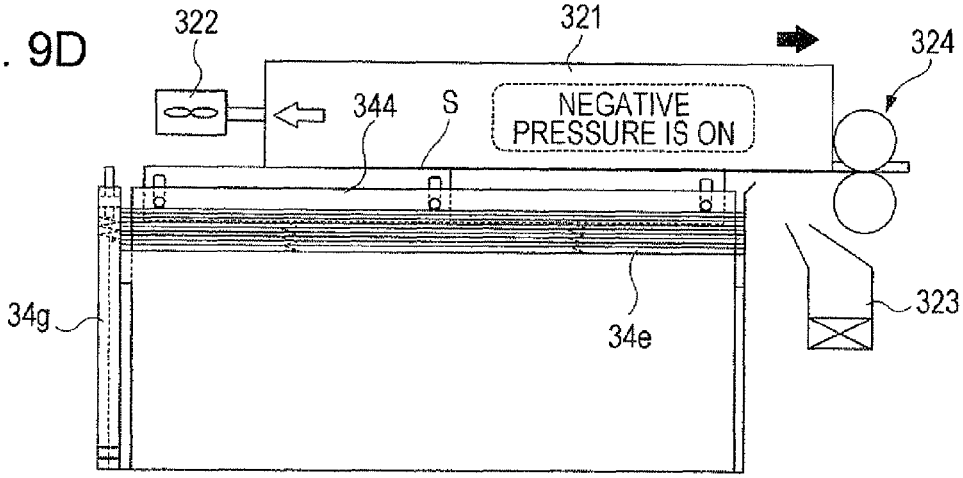

The air plenum 321 that has drawn the topmost sheet S thereto by suction moves to the right as illustrated in FIG. 9D, and the sheet S is delivered to the transport rollers 324. In this state, the blower 323 is stopped, that is, the blowing of air is stopped.

Figure 9E:
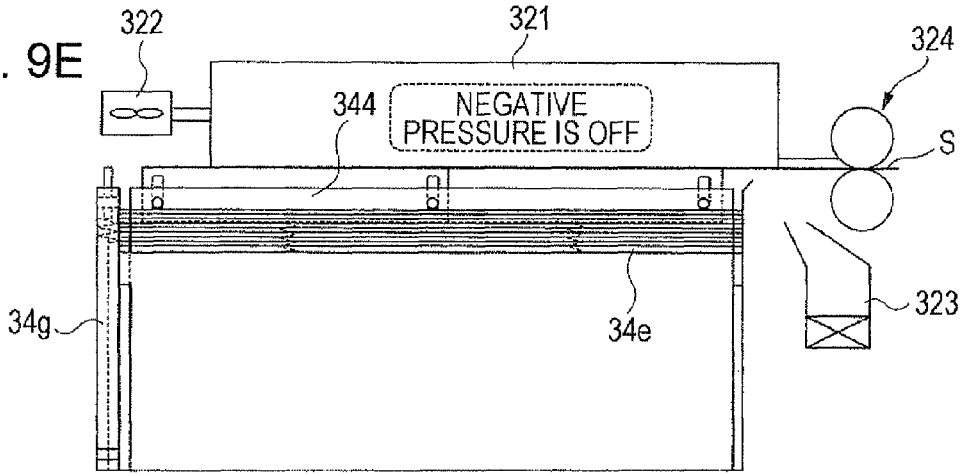

When the sheet S starts to be transported by the transport rollers 324, the fan 322 is stopped as illustrated in FIG. 9E and the negative pressure generated in the air plenum 321 is eliminated. Thus, the sheet S is easily released from the sheet suction surface 350 of the air plenum 321 and is smoothly transported by the transport rollers 324.

Figure 9F:
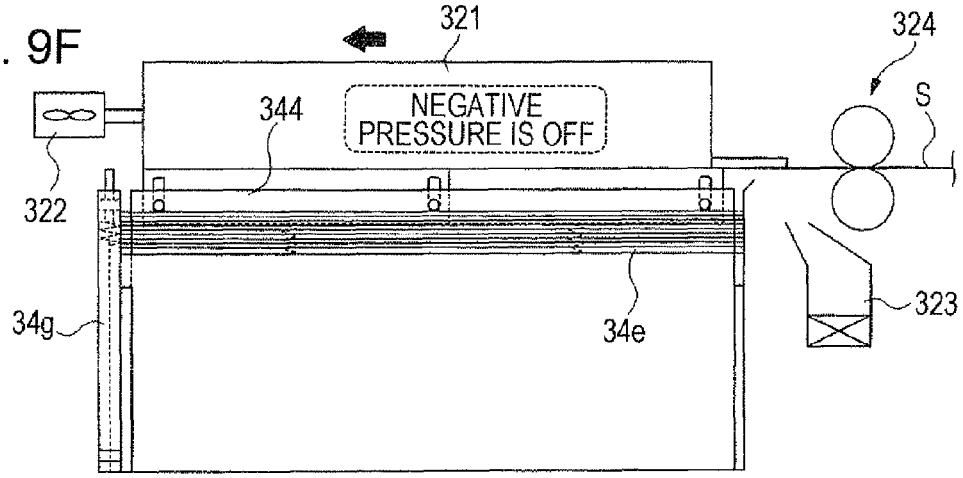

When the sheet S has been delivered to the transport rollers 324, the air plenum 321 moves to the left and returns to the initial position as illustrated in FIG. 9F. The first feeding device 30 feeds sheets S one by one by repeating a series of operations illustrated in FIGS. 9C to 9F until refill sheets S need to be supplied. When refill sheets S need to be supplied, the feeding of sheets S is stopped, and the bottom plate 34*e* is moved to the refilling position illustrated in FIG. 9A.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-material-feeding device comprising:

a stacking portion that holds a stack of recording materials;

a lifting member that moves the stacking portion up and down between a feeding position at which a recording material is fed and a refilling position at which refill recording materials are supplied;

a suction member that draws one or more recording materials by suction with a negative pressure;

a negative-pressure-generating member that generates the negative pressure in the suction member; and a stopping member that stops an edge of the stack of recording materials on the stacking portion and includes a sealing member that that is movably connected to a base of the stopping member so as to be able to move up and down, the sealing member is configured to maintain the level of the negative pressure in the suction member, wherein the sealing member of the stopping member is movable up and down between a retracted position at which refill recording materials are supplied and a sealing position at which the level of the negative pressure in the suction member is maintained, the sealing member moving with the up-and-down movement of the stacking portion.

2. The recording-material-feeding device according to claim 1, wherein the sealing member of the stopping member is retracted in the stopping member when the stacking portion is at the refilling position.

3. The recording-material-feeding device according to claim 2, further comprising a blower member that blows air onto the one or more recording materials drawn to the suction member.

4. The recording-material-feeding device according to claim 2, wherein the suction member further includes a sealing member that maintains the level of the negative pressure in the suction member.

5. The recording-material-feeding device according to claim 4, further comprising a blower member that blows air onto the one or more recording materials drawn to the suction member.

6. The recording-material-feeding device according to claim 1, wherein the suction member further includes a sealing member that maintains the level of the negative pressure in the suction member.

7. The recording-material-feeding device according to claim 6, further comprising a blower member that blows air onto the one or more recording materials drawn to the suction member.

8. The recording-material-feeding device according to claim 1, further comprising a blower member that blows air onto the one or more recording materials drawn to the suction member.

9. An image forming apparatus comprising:

an image forming section that forms an image on a recording material; and a recording-material-feeding section, the recording-material-feeding section including a stacking portion that holds a stack of recording materials;

a lifting member that moves the stacking portion up and down between a feeding position at which a recording material is fed and a refilling position at which refill recording materials are supplied;

a suction member that draws one or more recording materials by suction with a negative pressure;

a negative-pressure-generating member that generates the negative pressure in the suction member; and a stopping member that stops an edge of the stack of recording materials on the stacking portion and includes a sealing member that that is movably connected to a base of the stopping member so as to be able to move up and down, the sealing member is configured to maintain the level of the negative pressure in the suction member, wherein the sealing member of the recording-material-feeding section is movable up and down between a retracted position at which refill recording materials are supplied and a sealing position at which the level of the negative pressure in the suction member is maintained, the sealing member moving with the up-and-down movement of the stacking portion.

* * * * *